US006986297B2

(12) United States Patent
Scott

(10) Patent No.: US 6,986,297 B2
(45) **Date of Patent: *Jan. 17, 2006**

(54) METHOD OF MANUFACTURING PDC CUTTERS WITH CHAMBERS OR PASSAGES

(75) Inventor: Danny E. Scott, Montgomery, TX (US)

(73) Assignee: Baker Hughes Incorporated, Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/721,528

(22) Filed: Nov. 24, 2003

(65) Prior Publication Data

US 2004/0103757 A1 Jun. 3, 2004

Related U.S. Application Data

(63) Continuation of application No. 09/495,143, filed on Jan. 31, 2000, now Pat. No. 6,655,234.

(51) Int. Cl.
*B21K 5/04* (2006.01)

(52) U.S. Cl. ..... 76/108.2; 76/DIG. 11; 76/DIG. 12; 419/28; 175/393; 164/132

(58) Field of Classification Search ..... 76/108.2, 76/108.4, 108.1; 175/393, 434; 164/132, 164/97, 98; 228/122.1; 419/28, 37; 51/293, 51/295

See application file for complete search history.

(56) References Cited

U.S. PATENT DOCUMENTS 1,554,697 A 9/1925 Alden
3,311,956 A 4/1967 Townsend et al.
3,645,491 A 2/1972 Brown et al.
3,745,623 A * 7/1973 Wentorf et al. ..... 407/119
3,903,951 A 9/1975 Kaneko et al.
3,913,280 A * 10/1975 Hall ..... 51/307
3,964,534 A 6/1976 Rabinowitz
4,303,136 A * 12/1981 Ball ..... 175/429
4,441,930 A 4/1984 Baudis et al.
4,452,324 A 6/1984 Jurgens
4,554,962 A 11/1985 Wright
4,606,418 A * 8/1986 Thompson ..... 175/429
4,743,481 A 5/1988 Quinlan et al.
4,802,525 A 2/1989 Heine et al.
4,852,671 A 8/1989 Southland
4,913,244 A * 4/1990 Trujillo ..... 175/65
4,913,247 A 4/1990 Jones (Continued)

FOREIGN PATENT DOCUMENTS

EP 0815995 A2 1/1998

(Continued)

*Primary Examiner*—Boyer D. Ashley
(74) *Attorney, Agent, or Firm*—TraskBritt

(57) ABSTRACT

A cutting element for a drill bit used in drilling subterranean formations is formed with an internal chamber or passage for the flow of drilling fluid therethrough. The cutting element includes a substrate having at least one internal passage, and prior to attaching a superabrasive table thereto, the at least one internal passage is filled with a removable, substantially incompressible filler material. Attachment or bonding of the superabrasive table to the substrate under high temperature and high pressure is accomplished without significant distortion of the shape and size of the internal passage. The filler material may be a crystalline salt such as sodium chloride or halite, which is removable by dissolution in water, or may be boron nitride or a volcanic material such as Pyrofolyte material which is mechanically removable.

21 Claims, 7 Drawing Sheets

U.S. PATENT DOCUMENTS 4,919,013 A 4/1990 Smith et al.
5,028,177 A 7/1991 Meskin et al.
5,115,697 A * 5/1992 Rodriguez et al. ..... 76/108.6
5,126,089 A 6/1992 Johnson et al.
5,303,785 A 4/1994 Duke
5,316,095 A 5/1994 Tibbitts
5,373,907 A 12/1994 Weaver
5,433,280 A 7/1995 Smith
5,435,403 A 7/1995 Tibbitts
5,544,550 A 8/1996 Smith
5,590,729 A 1/1997 Cooley et al.
5,598,621 A * 2/1997 Littecke et al. ..... 29/412
5,605,198 A * 2/1997 Tibbitts et al. ..... 175/432
5,662,183 A 9/1997 Fang
5,787,022 A * 7/1998 Tibbitts et al. ..... 703/7
6,655,234 B2 * 12/2003 Scott ..... 76/108.2

FOREIGN PATENT DOCUMENTS

GB 2236699 A 4/1991
GB 2268527 1/1994
GB 2278558 A 7/1994
GB 2296880 A 7/1996
GB 2318994 A 4/1998
GB 2318993 A 5/1998
WO WO 97/29885 8/1997
WO WO 98/13317 4/1998
WO WO 00/05063 2/2000

* cited by examiner

METHOD OF MANUFACTURING PDC CUTTERS WITH CHAMBERS OR PASSAGES

CROSS-REFERENCE TO RELATED APPLICATIONS

This application is a continuation of application Ser. No. 09/495,143, filed Jan. 31, 2000, now U.S. Pat. 6,655,234, issued Dec. 2, 2003.

BACKGROUND OF THE INVENTION

1. Field of the Invention

This invention relates generally to superabrasive inserts or compacts for abrasive cutting of rock and other hard materials. More particularly, the invention pertains to methods for manufacturing polycrystalline diamond compact (PDC) cutting elements with internal chambers or passages, such cutting elements being mountable on earth-boring drill bits and the like.

2. State of the Art

Drill bits for oil field drilling, mining and other uses typically comprise a metal body into which replaceable cutting elements are incorporated. Such cutting elements, also known in the art (depending on their intended use) as inserts, compacts, buttons, cutters and cutting tools, are typically manufactured by forming a hard abrasive layer on the tip of a sintered carbide substrate. As an example, polycrystalline diamond may be sintered onto the surface of a cemented carbide substrate under high temperature and pressure, typically about 1450–1600° C. and about 50–70 kilobar. During this process, a metal sintering aid such as cobalt may be premixed with the powdered diamond or swept from the substrate into the diamond to form a bonding matrix at the interface between the diamond and substrate. The process is conducted in a high-pressure press receptacle or cell and is commonly known as a high-temperature, high-pressure (HTHP) process.

During drilling operations, cutters are subjected to high temperatures and very high forces imparted upon the cutters in various directions, leading to rapid fracture, delamination, or spalling of the superabrasive table and the underlying substrate.

The introduction of drilling fluids at the cutting end, or face, of the drill bit has long been known as advantageous for cooling the drill bit and washing out formation chips and rock particles from the cutting area. The drilling fluids are typically passed through the tubular drill string and into the bit body itself, which has outlets for discharging the drilling fluid at its cutting end. However, such an arrangement is not always sufficient to maintain the cutting elements themselves at a desired reduced temperature for prolonging their life.

U.S. Pat. No. 5,435,403 of Tibbitts discloses cutting elements formed of a superabrasive material mounted on a substrate. Various interfacial configurations are taught.

U.S. Pat. Nos. 5,316,095 of Tibbitts and 5,590,729 of Cooley et al., both assigned to the assignee hereof, Baker Hughes Incorporated, and hereby incorporated by reference herein, disclose cutting elements which have internal chambers and/or passages within the substrates thereof. These chambers and passages serve for passing drilling fluid to directly cool the diamond tables as well as for flushing cutting-induced chips of formation or other drilling-produced solids from the cutting surfaces engaging the formation. The internal chambers and/or passages are formed either during the formation of the substrate, or by machining, drilling, or other procedures subsequent to the construction of the substrate but before attachment of the superabrasive table thereto. The superabrasive table and substrate are usually bonded together by using a known HTHP process. As shown in these references, many different variations in cutting element types, sizes, shapes, and passage configurations are possible.

While the internally cooled cutting element is conceptually advantageous from a longevity standpoint, its construction has been difficult and time consuming, with all too frequently occurring problems arising in the HTHP bonding process. A primary problem is that during the HTHP process for bonding of the superabrasive, typically a diamond containing, table to the substrate, the substrate material, typically a carbide such as tungsten carbide, can yield under pressure and be forced into preformed passage(s) in the substrate, thereby constricting or even wholly blocking the preformed passage(s). In some cases, the substrate may collapse and even break, ruining the cutting element. In addition, diamond particles also may be forced into the preformed passage(s), closing off some as well as decreasing the diamond table thickness and integrity. In order to maintain an open passage for the flow of drilling fluid, the intrusive material, e.g., very hard carbide or diamond material, must be mechanically removed. Effective removal is difficult and costly, if not impossible, and the resulting cutting element may not be as structurally strong as an element having had no carbide and/or diamond material in the internal passage or cavity.

Forming a non-linear or complex-shaped passage or cavity, or passages or cavities, in a suitable location in a substrate following bonding to a superabrasive table is very difficult, inasmuch as precise drilling/machining of the very hard carbide of the substrate in different directions is generally required, and the attached superabrasive table may block access for drilling the interior of the substrate in the required directions.

A satisfactory method is needed for fabricating cutting elements with internal substrate passages with a high degree of reproducibility and reliability while significantly reducing the cost of manufacture, inasmuch as the present manufacturing methods are inadequate in that regard.

BRIEF SUMMARY OF THE INVENTION

The present invention provides a cutting element for a drill bit, in which the cutting element has internal cavities forming at least one passage therein. The present invention also provides a superabrasive cutting element with at least one internal passage enabling passage of drilling fluid therethrough and into the cutting area for cooling the cutting element and removing cuttings generated by the cutting surfaces of the cutting elements as the cutting elements engage a formation. Additionally, the present invention provides a superabrasive cutting element having at least one internal fluid flow passage with reduced frictional resistance with respect to fluid flow therein.

The present invention includes methods for forming a superabrasive cutting element with at least one internal passage of a consistently controllable shape and size. The present invention yet further includes methods for forming a superabrasive cutting element having an internal chamber adjacent a cutting table interface for passage of cooling fluid past the cutting table. The present invention yet still further includes methods for forming a superabrasive cutting element having at least one internal passage, the size and shape of which is maintained in a HTHP fabrication step.

The invention comprises a method for manufacturing a cutting element having a superabrasive layer, or table, bonded to a substrate having at least one internal cavity, or passage. The cavity may comprise, for example, a continuous hollow passage through which a cutting fluid may be introduced from the bit body or a stud thereof so as to exit proximate the table of the cutting element for cooling the table as well as the cutting element.

In the present invention, a substrate is first formed with an internal cavity, and prior to attaching or bonding a superhard table thereto, the cavity is packed with a substantially rigid, solid filler material which may readily be removed following HTHP bonding. The filler material prohibits or, at a minimum, resists encroachment of either the substrate or table material into the internal cavity during the HTHP process.

The present invention also contemplates fabrication of a drill bit including cutting elements formed to the present invention wherein the drill bit has at least one internal passage for communication with at least one passage or cavity formed in the cutting elements.

BRIEF DESCRIPTION OF THE SEVERAL VIEWS OF THE DRAWINGS

The following drawings illustrate various embodiments of the invention, not necessarily drawn to scale, wherein.

Figure 9:
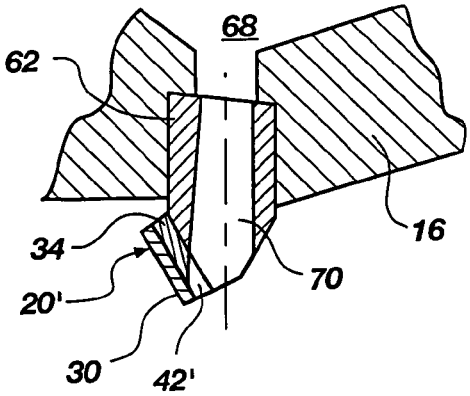
Figure 10:
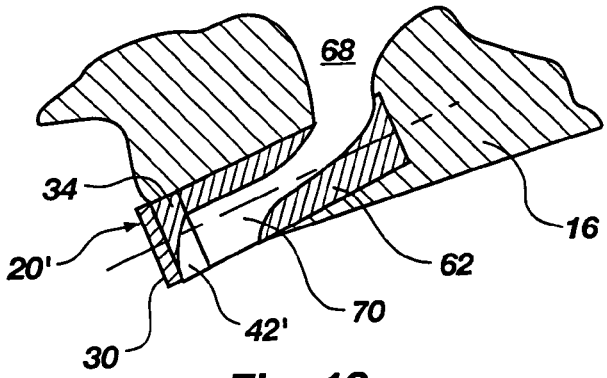
Figure 11:
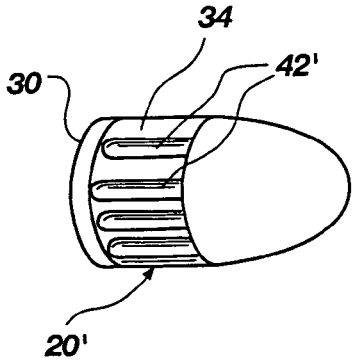
Figure 14:
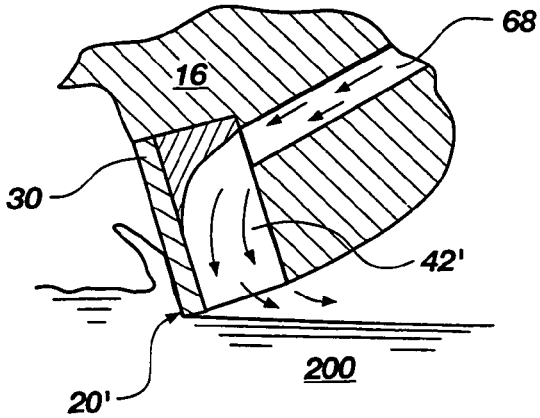
Figure 12:
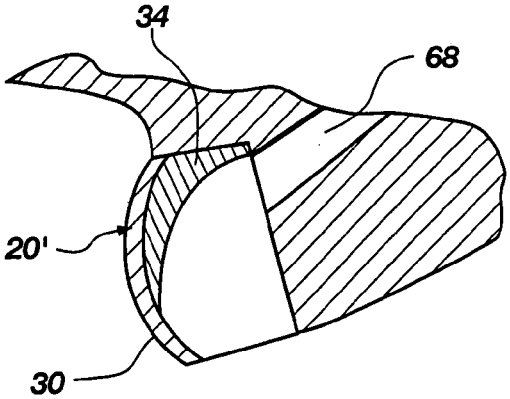
Figure 13:
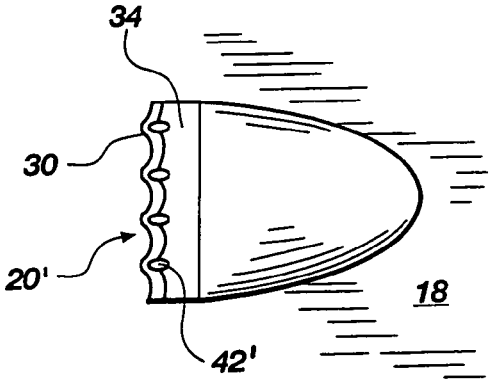
Figure 15:
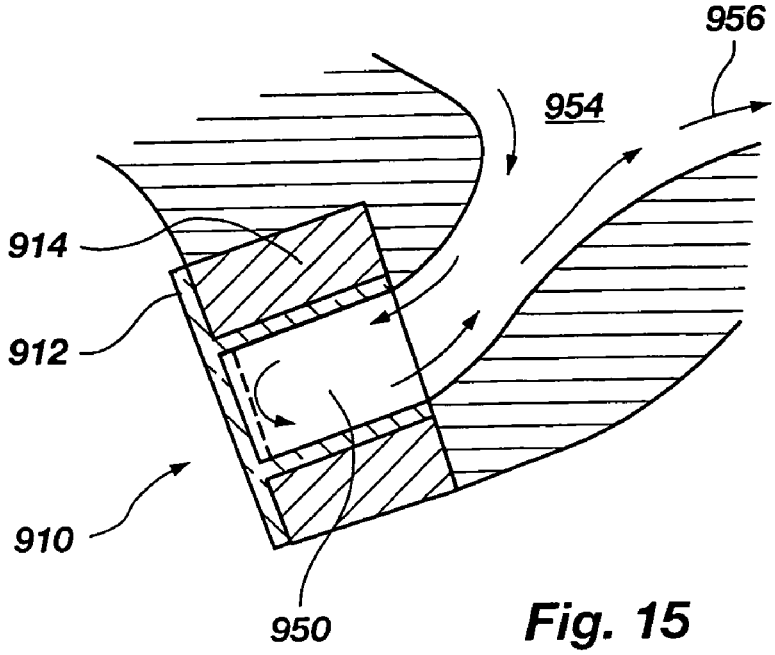
Figure 16:
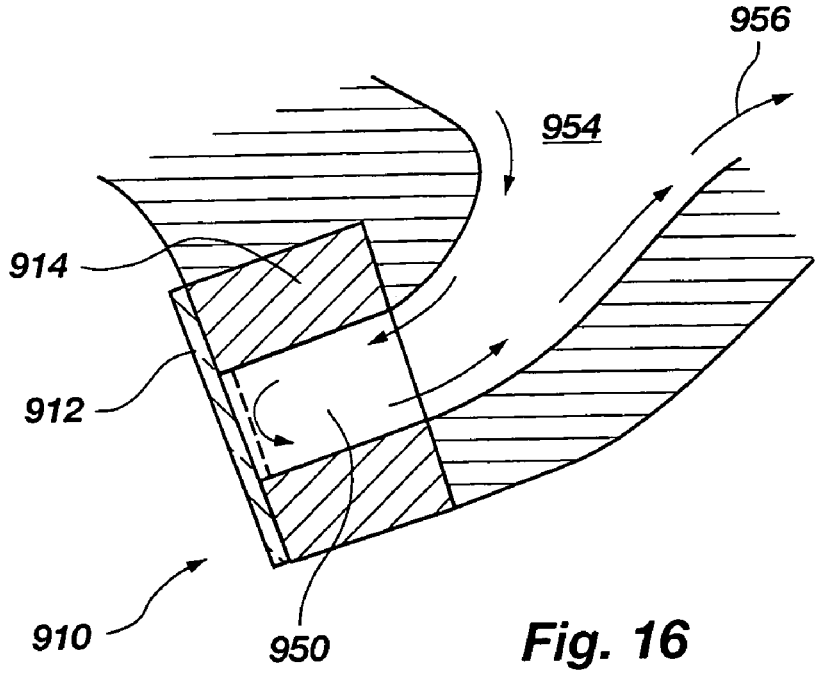
Figure 17:
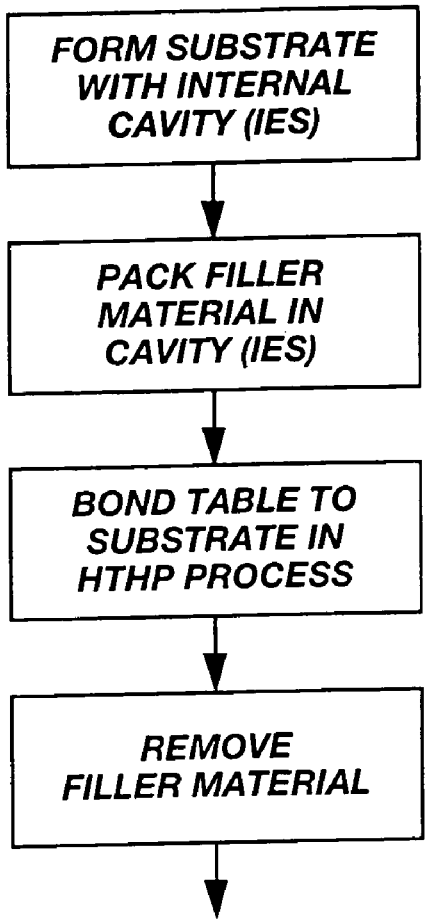
Figure 18:
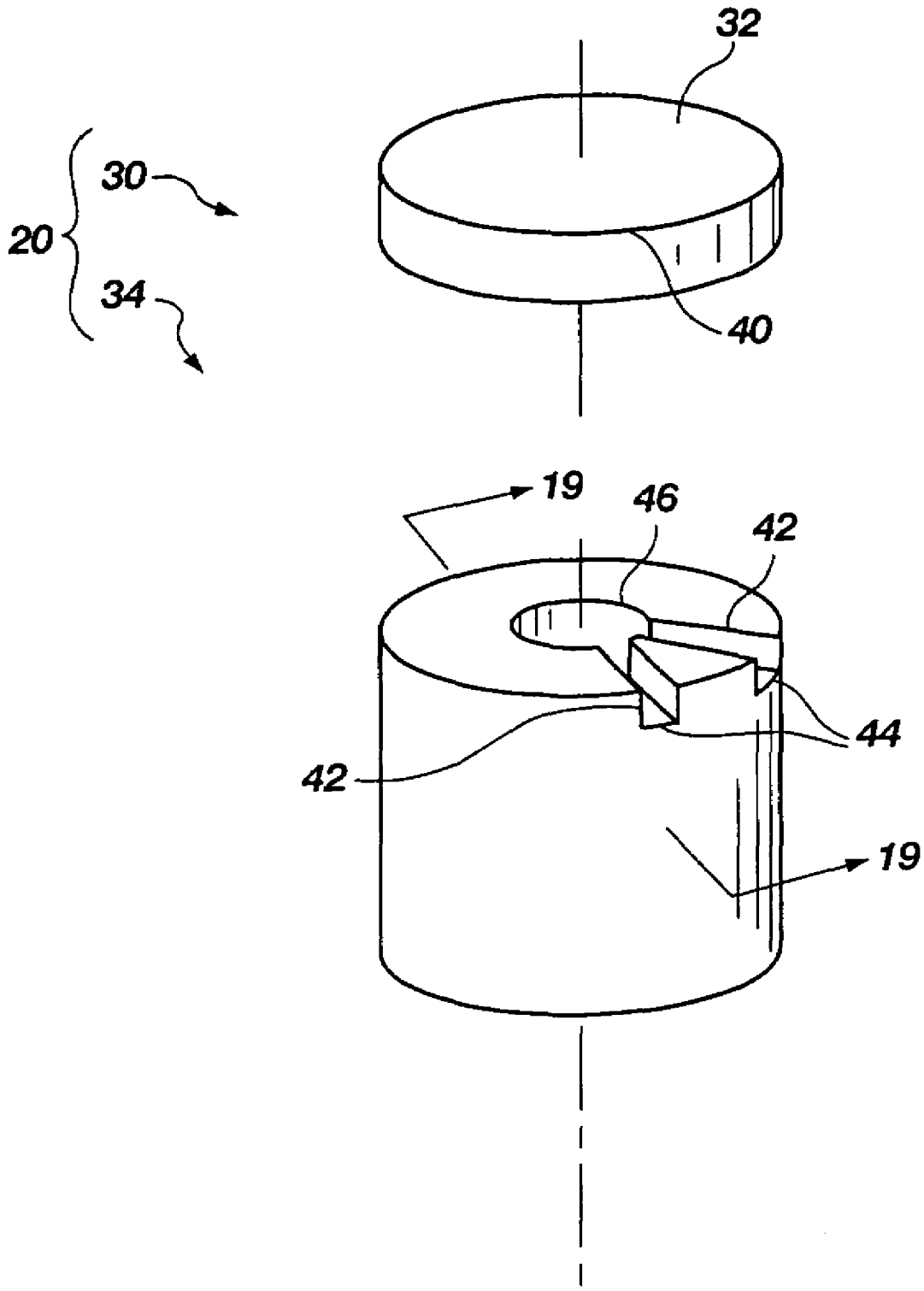

FIG; 8 is a side elevation view of another cutting element with an internal passage and mounted in a bit;

FIGS. 9, 10 and 11 depict cutting elements with slots or grooves communicating with the rear of the substrates;

FIG. 12 is a cross-sectional side view of a cutting element with an internal passage and mounted in a bit;

FIG. 13 is a side view of a cutting element with internal channels and mounted in a bit;

FIG. 14 is a cross-sectional view of a cutting element with an internal chamber and mounted in a bit and shown engaging a subterranean formation;

FIG. 15 is a cross-sectional side view of a cutting element with an internal cavity and mounted in a bit;

FIG. 16 is a cross-sectional side view of a cutting element with an internal cavity and mounted in a bit;

FIG. 17 is a block diagram of the general steps of a process embodying the present invention for forming a cutting element with an internal cavity;

FIG. 18 is an isometric exploded side view of an exemplary cutting element during a manufacturing process of the invention; and FIGS. 19A–H are diagrammatic views illustrating steps embodying the present invention for fabricating the exemplary cutting element depicted in FIG. 18 as taken along line 19—19.

DETAILED DESCRIPTION OF THE INVENTION

The preferred method of the invention and various exemplary drill bit cutting elements formed thereby are illustrated in the figures.

The preferred method includes fabricating a drill bit cutting element 20 typically having a polycrystalline diamond compact (PDC) layer to form a superabrasive, or diamond, cutting table 30 which is bonded to a substrate 34. Substrate 34 is characterized in that it includes an internal cavity 46 such as a channel in which a liquid, e.g., drilling fluid or mud, is passed for circulating chips away from the region in which cutting is occurring and for cooling purposes.

Figure 1:
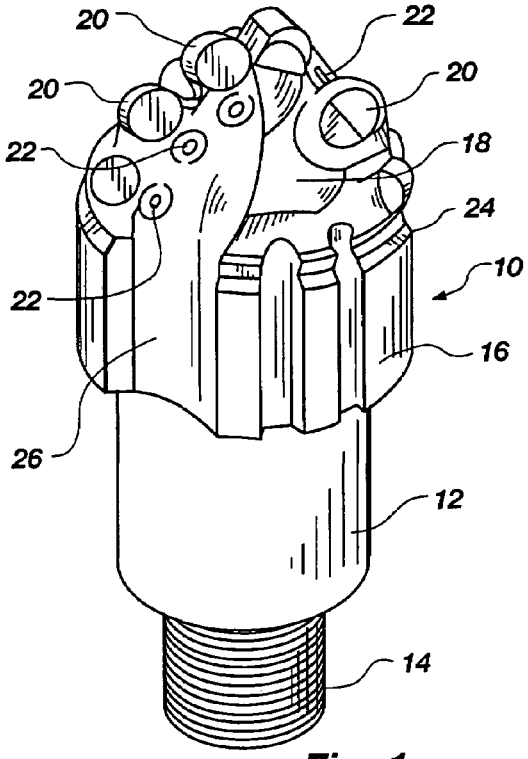
FIG. 1 is a perspective view of a drill bit incorporating a plurality of cutting elements with internal chambers or passages, as manufactured by a method of the invention.
Figure 1A:
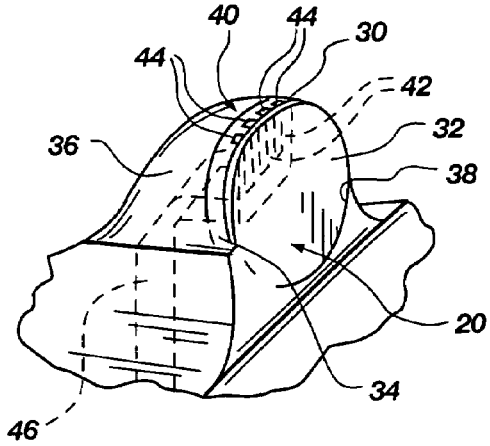
FIG. 1A is an enlarged perspective view of a cutting element with internal passages and manufactured in accordance with a method of the invention, mounted on the face of the bit of FIG. 1.
Figure 1B:
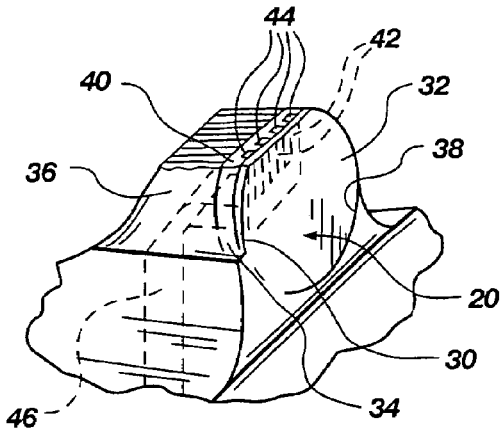
FIG. 1B is an enlarged perspective view of the cutting element of FIG. 1A after use in drilling a borehole.
Figure 2:
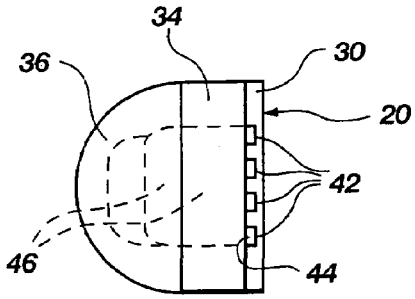
FIG. 2 is a top elevation of another cutting element with internal passages.
Figure 3:
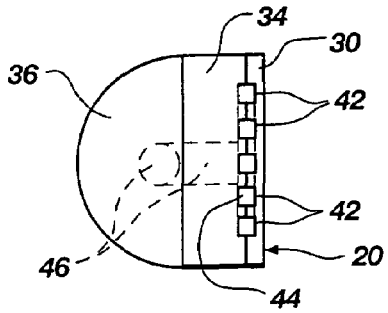
FIGS. 3 and 3A are, respectively, top and front elevation views of a cutting element with internal passages.
Figure 3A:
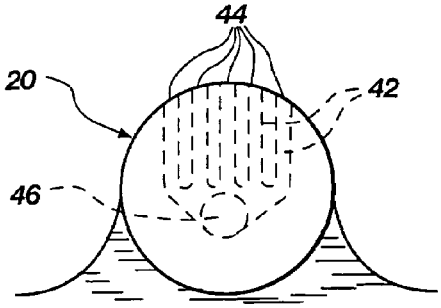

In FIG. 1 is shown an exemplary, but not limiting, drill bit 10 which incorporates at least one cutting element or drill bit cutter 20 of the invention. The illustrated drill bit 10 is known in the art as a fixed cutter, or drag, bit useful for drilling in earth formations and is particularly suitable for drilling oil, gas, and geothermal wells. Cutting elements 20 made with the present invention may be advantageously used in any of a wide variety of drill bits 10 configured to use cutting elements. Drill bit 10 includes a bit shank 12 having a pin end 14 for threaded connection to a tubular drill string, not shown, and also includes a body 16 having a bit face 18 on which cutting elements 20 may be secured. Bit 10 typically includes a series of nozzles 22 for directing drilling fluid, or mud, to the bit face 18 for circulating and removing chips or cuttings of the formation to the bit gage 24 and passage thereof through junk slots 26, past the bit shank 12 and drill string to the surface.

FIGS. 1 through 16 show a wide variety of configurations of cutting elements 20 manufacturable by the method of the invention, but are not meant to comprise limitations thereof.

As depicted in FIGS. 1A, 1B, 2, 3 and 3A, an exemplary cutting element 20 formed by the method of the invention comprises a PDC cutting element including a diamond layer or superabrasive table 30 having a front face 32 and a rear face (not shown) bonded to a disc-shaped substrate 34 of similar configuration. Front face 32 is maintained on the bit face 18 by brazing to a bit body 16 or to a carrier element secured thereto, or by direct bonding during formation of the bit body 16 during fabrication of the bit 10. Cutting element 20 is supported from the rear against impact by protrusion 36 on the bit body face 18 which, as shown, defines a socket or pocket 38 in which the cutting element is cradled. Alternatively, cutting element 20 may be mounted on a cylindrical or stud-type carrier element, the latter type being press-fit or mechanically secured to the bit body 16, while both cylinders and studs may be braced therein.

Cutting elements 20 include peripheral cutting edges or formation contact zones 40 which engage the subterranean formation as the bit 10 is rotated and a longitudinal force is applied to the bit by way of the drill string.

As disclosed herein, cutting element 20 includes at least one cavity 46 which opens into one or more channels 42 shown with outlets 44. Channels 42 are shown as formed at the table/substrate interface, either within the superabrasive table 30 or substrate 34, or partially within both. While drilling a bore hole with a drill bit 10 of this construction, a drilling fluid, not shown, may be pumped through the cavity 46, channels 42 and outlets 44 to cool and lubricate the cutting element 20 and to flush cuttings from the bore hole.

Figure 8:
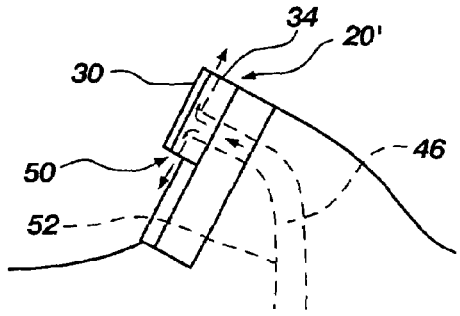

FIGS. 4 through 13 illustrate other cutting elements 20 having an internal cavity 46. In general, outlets 44 lie at the periphery of and below superabrasive table 30. However, as shown in FIG. 8, an aperture 50 may be formed in superabrasive table 30 of alternate cutting element 20', serving as an outlet for drilling fluid.

Figure 4:
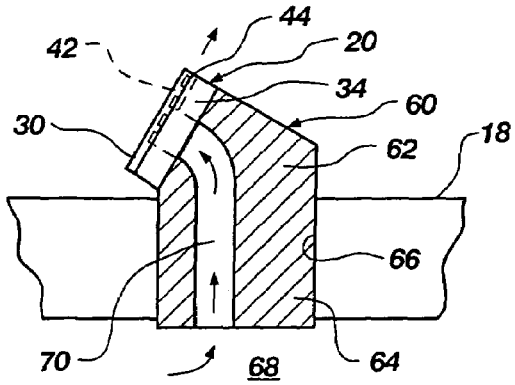
FIG. 4 is a side sectional view of a stud-type cutter employing a cutting element with an internal passage in a bit.
Figure 7:
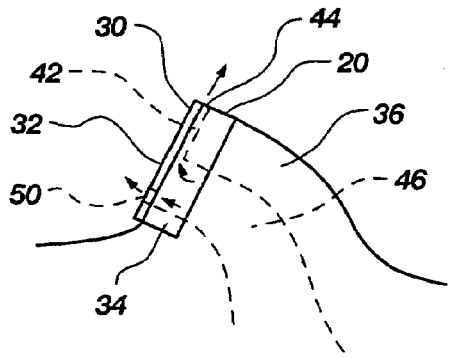
FIG. 7 is a side elevation view of an additional cutting element with an internal passage and mounted in a bit.

In FIG. 4 is shown a stud type cutter 60, wherein substrate 34 of cutting element 20 is mounted on a stud 62 whose lower end 64 is secured in an aperture 66 in bit face 18. Fluid from a plenum 68 may be passed through passage 70 to channels 42 and discharged from outlets 44 preferably adjacent superabrasive table 30.

Figure 5:
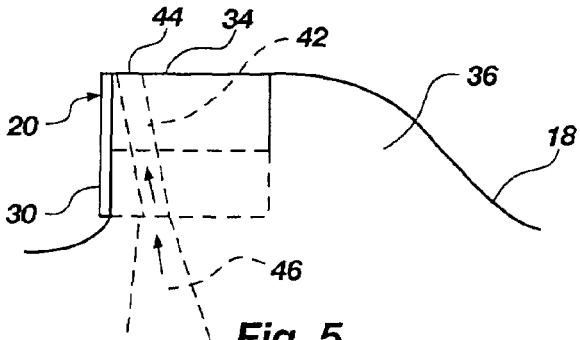
FIG. 5 is a side elevation view of a further prior art cutting element with an internal passage and mounted in a bit.
Figure 6:
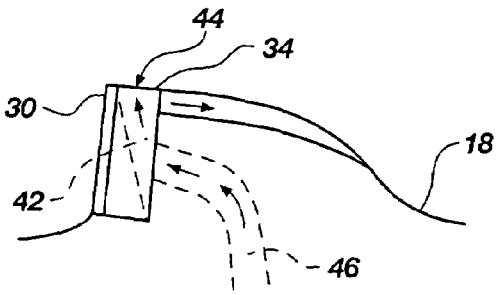
FIG. 6 is a side elevation of another cutting element with an internal passage and mounted in a bit.

As shown in the embodiments of FIGS. 5 and 6, channels 42 optimally do not actually abut superabrasive table 30 but are nevertheless generally proximate thereto in a preferred embodiment.

FIGS. 8 through 14 depict other cutting elements 20' having a variety of differently shaped cavities or channels 42 and 42'.

FIG. 14 shows a cutter 20' mounted in a bit body 16 as cutter 20' engages a subterranean formation 200.

In FIG. 11 is shown a cutting element 20' having a substrate 34 with flow channels 42' on the exterior surface thereof. Such exterior channels 42' may be preformed in the substrate 34 and protected against distortion by the present invention.

FIGS. 15 and 16 illustrate cutting elements 910 with substrates 914 having cavities 950 which abut cutting tables 912 in dead-end fashion. In this embodiment, a fluid 956 may be directed into cavities 950 from plenums 954.

Figure 19:
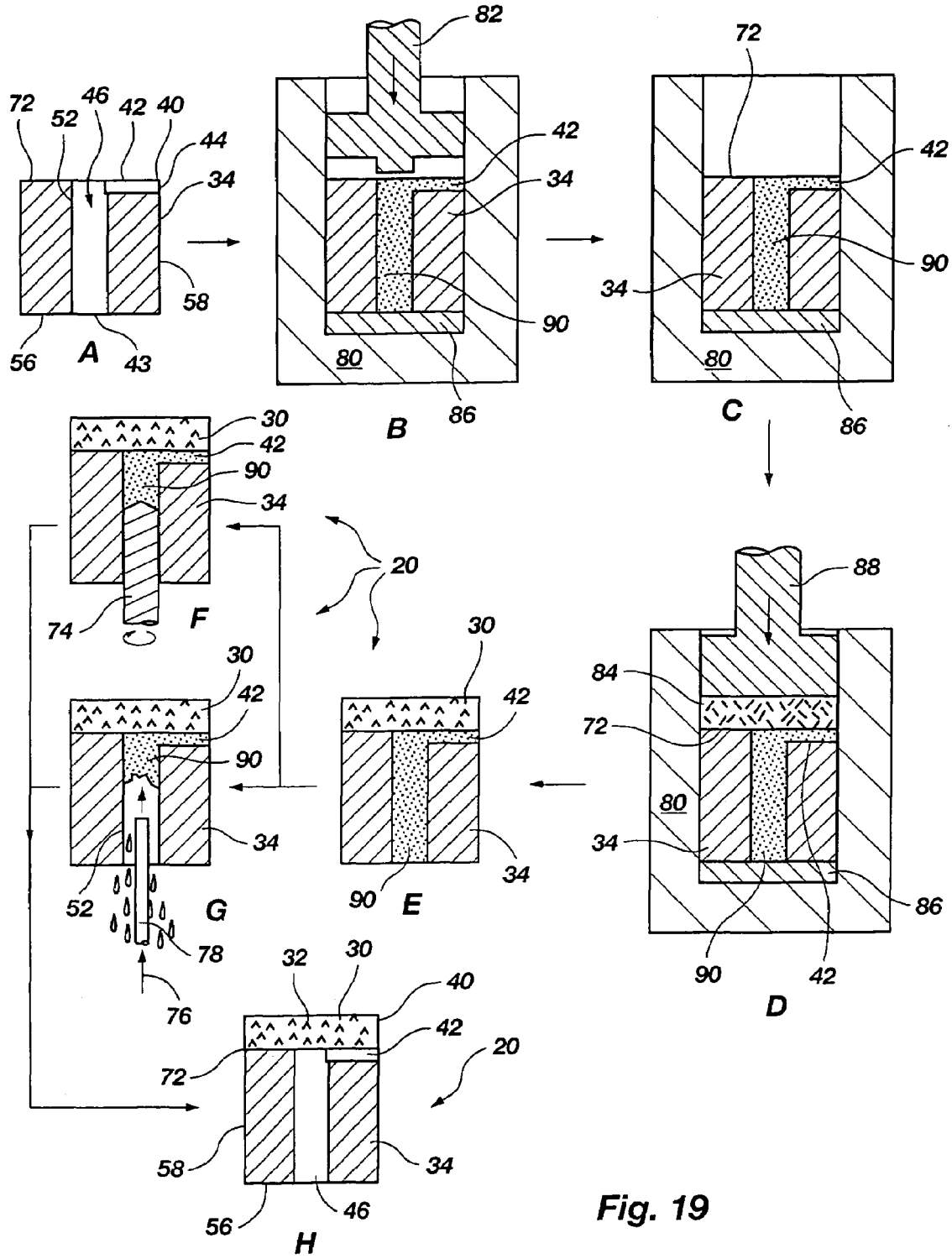

The preferred method of the invention is outlined in FIGS. 17, 18 and 19, and illustrates the difficulties overcome by the present invention in manufacturing cavitied cutting elements 20, 910 of the previous FIGS. 1 through 16, as well as others not shown.

An exemplary cutting element 20 formed by the preferred method of the invention is shown in FIG. 18. It includes a superabrasive table 30 and substrate 34. Substrate 34 is shown as having a generally longitudinally oriented internal cavity 46 passing through it and side channels 42 communicating with the cavity 46 for passing fluid therethrough and discharging fluid through outlets 44.

Steps of the preferred method are illustrated in FIG. 19 for constructing the exemplary substrate 34 shown in FIG. 18.

Substrate 34 of FIG. 19A is formed typically of tungsten carbide. The substrate 34 may be molded to include a cavity or cavities 46, including channel(s) 42 each having an inlet 43 and outlet(s) 44 for passage of cutting fluid, not shown, to the cutting edge(s) 40 of the superabrasive table 30. Optionally, exterior channels 42' shown in FIG. 11 may be formed in substrate 34 but are not used in this example.

In an alternative method, cavity or cavities 46 in substrate 34 are formed by, e.g., drilling and/or machining of a preformed substrate 34.

As depicted in FIG. 19B, substrate 34 with internal cavity 46 is placed in a cell or receptacle 80, and a filler material 90 is packed into the cavity or cavities 46 (including channels 42) to fill the space preferably with a solid mass having relatively low compressibility. For example, a ram 82 may be used to pack the filler material 90 to the desired density. Excess filler material 90 is then removed, resulting in substrate 34 supported against collapse by compressed filler material 90, as depicted in FIG. 19C. Filler material 90 is shown as a crystalline salt, but may comprise other materials having the appropriate properties. As shown, the substrate 34 may be placed on a plate 86 within the cell 80.

As illustrated in FIG. 19D, a layer 84 of particulate diamond crystals is placed atop substrate 34, and the loaded receptacle or cell 80 is subjected to a HTHP process schematically shown in FIG. 17. For example, a ram 88 may be used to compress the diamond layer 84 and substrate 34 at high temperature to form a superabrasive diamond layer or table 30 (shown in FIG. 19E) securely bonded to the upper surface 72 of substrate 34. If desired, a metal catalyst, not shown, may be included to enhance the table formation and bonding strength.

The conditions of the HTHP process are typically carried out at about 50–70 kilobar of pressure and at temperatures typically of about 1450–1600° C., and for a time period sufficient to form the superabrasive table 30 and tenaciously and securely bond substrate 34 and superabrasive table 30 to each other.

As shown in FIG. 19E, cutting element 20 may then be removed from cell 80.

Filler material 90 is then removed from the cavity or cavities 46, typically by dissolution, melting, mechanical removal, chemical removal, or other suitable means. FIG. 19F illustrates mechanical removal of filler material 90 by a drill, reamer, or other tool 74. FIG. 19G illustrates removal of filler material 90 from cavities 46, including channels 42, with a water stream 76 introduced through tube 78. The soluble filler material 90, e.g., salt, is simply dissolved within the water and flows away.

In an alternative method, not illustrated, filler material 90 comprises a material which is solid at the HTHP conditions previously discussed, for example, but melts at a temperature preferably nearly equal to or less than at the HTHP condition when at atmospheric pressure, or when subjected to a vacuum. Thus, filler material 90 is then removed by melting.

Optional methods for removal of filler material 90 include merely scraping it from cavity 46 with a hand tool, or using an erosive, e.g., sand or grit, blast to erode it away.

The completed cutting element 20 is then ready for attachment to a stud (not shown) or directly to a drill bit 10 for use.

As can be appreciated, the preferred manufacturing process may be modified in a variety of ways, without departing from the scope of the present invention.

In one alternative, for example, cell 80 is filled in reverse order. Thus, diamond layer 84 is first formed in cell 80. Substrate 34 is then inserted, upside-down. The cavities 46 are filled with filler material 90 and compacted, followed by the previously discussed HTHP process. Removal of filler material 90 may be according to any effective manner. This method is especially useful where cavity 46 does not extend fully to the upper (interfacial) surface 72 of the substrate 34. Thus, cavity 46 is filled with filler material 90 from the mounting end 56 of the substrate 34, i.e., opposite the interfacial surface 72.

Where a substrate 34 is of irregular shape, and/or the cavity 46 passes one or more sides 58 of the substrate 34 without passing through interfacial surface 72 and mounting end 56, cell 80 will be somewhat larger than the substrate 34. Filler material 90 is packed into the cell 80 to both fill the cavity 46 as well as substantially surround substrate 34, thereby leaving interfacial surface 72 exposed to superabrasive layer 84 of, e.g., diamond material. Thus, a cutting element 20 having any shape may be formed in accordance with the process of the present invention.

In another embodiment of the invention, superabrasive table 30 itself has one or more outlets 44 for passage of drilling fluid to the front face 32 of superabrasive table 30.

In another alternative, the invention is combined with a layering method of making the drill bit 10. Cutting element 20 may be designed to include multiple cavities 46 and channels 42, possibly creating complex passages. With the design of complex passages in the cutting element 20, more complex internal passages may be required in the drill bit body 16 and face 18 for connection with the corresponding passages in the cutting element 20. U.S. Pat. No. 5,433,280 of Smith, assigned to the assignee hereof, Baker Hughes Incorporated, and hereby incorporated by reference herein, discloses a layering method for manufacturing a drill bit 10 which would be suitable for designing such complex passages. The method, as disclosed by Smith, is carried out by sequentially depositing thin layers of a material upon one another and then fusing them together. Thus, the outer shape of the bit as well as inner passages and structures are defined incrementally layer by layer. By using such a method for the manufacture of a drill bit 10 in conjunction with the invention described herein, more numerous and complex passageways could be designed in both the cutting elements and the bit to which they are mounted for greater efficiency with respect to heat transfer and fluid flow properties.

The preferred process illustrated in FIGS. 19A–H having simplified components is exemplary, or suggestive, of that used in a more complex manufacturing method embodying the present invention. At a production scale, for example, cells 80 may be configured to simultaneously form a plurality of cutting elements 20, and other equipment differences may be used, including automation of the process. Any cell configuration which enables the preferred HTHP fabrication process of constructing a cutting element by incorporating a removable filler material 90 may be used.

The term "substantially incompressible" is used to denote that at the conditions encountered herein, the filler material will resist and/or prevent any substantial encroachment of the substrate material and/or table material into cavity 46. In most cases, the term "substantially incompressible" implies that the extent of volume reduction due to being subjected to compressive forces will typically be less than about 15 percent (15%).

Removable filler material 90 may be any material which acts as a relatively rigid-body structural member during high-pressure sintering and is readily removed thereafter by dissolution, shaking out, digging out, melting, erosion, chemical transformation, or other process. Thus, applying or bonding superabrasive table 30 to substrate 34 under high temperature and high pressure (HTHP) is accomplished without significant collapse or distortion of the substrate material or table material into cavities 46, or roughening of cavity walls 52.

Removable filler material 90 is selected on the basis of a number of properties and characteristics, among which are the following exemplary characteristics:

Filler material 90 preferably forms a relatively rigid member, i.e., has limited compressibility at conditions at least up to and including the HTHP temperature and pressure.

Filler material 90 preferably is readily and easily removable following the HTHP process.

Filler material 90 may be granular, but preferably does not easily flow or migrate into the superabrasive table material, and preferably does not significantly flow or migrate into the filler material. If desired, a thin member comprising a layer of a generally non-penetrable material such as tungsten, or other refractory materials, may be inserted between the granular filler material 90, such as crystalline diamond particles, forming superabrasive table 30, to prevent diffusion therebetween. Of course, if the passage or passages formed in the substrate do not open onto the end thereof where the superabrasive table 30 is formed, this is not a concern.

Filler material 90 may be a salt such as halite or sodium chloride (NaCl), which material is readily packed into the voids or cavities 46 formed in substrate 34, is highly soluble in water at ambient conditions, and is non-toxic and inexpensive. Although a small quantity of carbide and/or diamond particles may infiltrate the interstices of the salt, the particles will be subsequently washed out of the cavities 46 by water or other solvent 76.

Filler material 90 may optionally comprise a natural volcanic material such as Pyrofolyte™ volcanic material commercially available from Ore and Metal Company, LTD., 6 Street, Andrews Road, Parktown, Johannesburg, South Africa. This material is relatively soft, and is readily mechanically removable from internal cavities 46 of a substrate 34.

Alternatively, a substance such as boron nitride may be used as filler material 90, which remains a solid at the high-temperature, high-pressure sintering conditions and is easily removed by mechanical means.

For the purposes described herein, methods of this invention for fabricating cutting elements having voids, cavities or passages therein are particularly suitable for use with the construction of any cutting element 20 having a superabrasive table 30 and a substrate 34 being attached or bonded together in a HTHP or equivalent process. The cavities 46 formed in such cutting elements 20 may have any purpose without departing from the invention. Thus, it will be appreciated that various additions, deletions, and modifications to the embodiments of the invention disclosed herein are possible without departing from the spirit and scope of the present invention as claimed.

What is claimed is:

1. A method for constructing a cutting element for a drill bit used in drilling subterranean formations, comprising:

forming a substrate of a hard material, the substrate having at least one internal cavity and an attachment surface;

filling the at least one internal cavity with a substantially incompressible packed, particulate filler material to a level at least coincident with the attachment surface;

attaching a superabrasive table to the attachment surface and over the substantially incompressible packed, particulate filler material at an elevated temperature of between about 1450 and 1600° C. and at a high pressure of at least about 50 kilobar while maintaining a presence of the at least one internal cavity of the substrate with the substantially incompressible packed, particulate filler material; and removing the filler material from the at least one internal cavity.

2. The method of claim 1, wherein removing the filler material comprises at least one of mechanically removing the filler material and dissolving the filler material.

3. The method of claim 1, wherein removing the filler material comprises removing a filler material which remains a solid at the elevated temperature and the high pressure and becomes fluid at a lesser temperature and a lesser pressure.

4. The method of claim 1, further comprising selecting the filler material from the group consisting of a crystalline salt, halite, sodium chloride, boron nitride, a volcanic material, and Pyrofolyte material.

5. The method of claim 1, wherein forming the substrate of a hard material comprises forming the substrate including the attachment surface having an outer periphery and further comprising:

forming at least one channel in the attachment surface of the substrate, the at least one channel having an outlet and an inlet, the outlet being proximate the outer periphery and the inlet being in communication with the at least one internal cavity;

filling the at least one channel with the substantially incompressible, packed particulate filler material to a level at least coincident with the attachment surface prior to attaching the superabrasive table to the attachment surface and maintaining a presence of the at least one channel during the attachment of the superabrasive table to the attachment surface with the substantially incompressible packed, particulate filler material; and removing the filler material from the at least one channel after attaching the superabrasive table to the attachment surface.

6. The method of claim 5, wherein removing the filler material comprises at least one of mechanically removing the filler material and dissolving the filler material.

7. The method of claim 5, wherein removing the filler material comprises removing the filler material which remains a solid at the elevated temperature and the high pressure and becomes fluid at a lesser temperature and a lesser pressure.

8. The method of claim 5, further comprising selecting the filler material from the group consisting of a crystalline salt, halite, sodium chloride, boron nitride, a volcanic material, and Pyrofolyte material.

9. The method of claim 1, wherein attaching the superabrasive table to the attachment surface further comprises:

forming the superabrasive table including a bonding surface having an outer periphery and further including at least one channel formed within the bonding surface, the at least one channel configured to have an inlet, and an outlet proximate the outer periphery;

filling the at least one channel with the substantially incompressible packed, particulate filler material to a level at least coincident to the bonding surface prior to attaching the superabrasive table to the attachment surface;

attaching the superabrasive table to the substrate with the inlet of the at least one channel in communication with the at least one internal cavity of the substrate while maintaining a presence of the at least one channel with the substantially incompressible packed, particulate filler material; and removing the filler material from the at least one channel.

10. The method of claim 9, wherein removing the filler material comprises at least one of mechanically removing the filler material and dissolving the filler material.

11. The method of claim 9, wherein removing the filler material comprises removing the filler material which remains a solid at the elevated temperature and the high pressure and becomes fluid at a lesser temperature and a lesser pressure.

12. The method of claim 9, further comprising selecting the filler material from the group consisting of a crystalline salt, halite, sodium chloride, boron nitride, a volcanic material, and Pyrofolyte material.

13. The method of claim 1, wherein forming the substrate of a hard material comprises forming the substrate including the attachment surface having an outer periphery and further comprising:

forming at least one channel in the attachment surface of the substrate, the at least one channel having an outlet and an inlet, the outlet being proximate the outer periphery of the attachment surface;

forming the superabrasive table to include a bonding surface having an outer periphery and at least one channel in the bonding surface, the at least one channel in the bonding surface having an inlet and an outlet, the outlet being proximate the outer periphery of the bonding surface;

placing the superabrasive table with the bonding surface over the attachment surface of the substrate with the at least one channel in the bonding surface and the at least one channel in the attachment surface in alignment so as to define at least one passage lying between the superabrasive table and the substrate;

filling the at least one passage with the substantially incompressible, packed particulate filler material;

attaching the bonding surface to the attachment surface at the elevated temperature and at the high pressure while maintaining a presence of the at least one passage with the substantially incompressible packed, particulate filler material and communication between the at least one internal cavity and the at least one passage; and removing the filler material from the at least one passage and the at least one internal cavity of the substrate.

14. The method of claim 13, wherein removing the filler material comprises at least one of mechanically removing the filler material and dissolving the filler material.

15. The method of claim 13, wherein removing the filler material comprises removing the filler material which remains a solid at the elevated temperature and the high pressure and becomes fluid at a lesser temperature and a lesser pressure.

16. The method of claim 13, further comprising selecting the filler material from the group consisting of a crystalline salt, halite, sodium chloride, boron nitride, a volcanic material, and Pyrofolyte material.

17. A method of constructing a cutting element for a drill bit used in drilling subterranean formations, comprising:

forming a primary substrate of a preselected hard material, the primary substrate having at least one internal cavity and an attachment surface;

forming a secondary substrate of a preselected hard material, the secondary substrate having an outer periphery and at least one channel therein, the at least one channel having an inlet and an outlet, the outlet being proximate to the outer periphery;

placing the secondary substrate on the attachment surface so as to create communication between the outlet of the at least one channel and the at least one internal cavity;

filling the at least one internal cavity and the at least one channel with a substantially incompressible packed, particulate filler material;

forming a superabrasive table on the secondary substrate, and forming the secondary substrate to the attachment surface at an elevated temperature of between about 1450 and 1600° C. and at a high pressure of at least about 50 kilobar while maintaining a presence of the at least one internal cavity of the primary substrate and the at least one channel of the secondary substrate with the substantially incompressible filler material; and removing the filler material from the at least one internal cavity and the at least one channel.

18. The method of claim 17, wherein removing the filler material comprises at least one of mechanically removing the filler material and dissolving the filler material.

19. The method of claim 17, wherein removing the filler material comprises removing the filler material which remains a solid at the elevated temperature and the high pressure and becomes fluid at a lesser temperature and a lesser pressure.

20. The method of claim 17, further comprising selecting the filler material from the group consisting of a crystalline salt, halite, sodium chloride, boron nitride, a volcanic material, and Pyrofolyte material.

21. A method for constructing a cutting element for a drill bit used in drilling subterranean formations, comprising:

forming a substrate of tungsten carbide, the substrate having at least one internal cavity, an attachment surface, and at least one exterior cavity at the attachment surface, the at least one exterior cavity being in communication with the at least one internal cavity;

placing the substrate in a holding receptacle;

filling the at least one internal cavity and the at least one exterior cavity to a level at least coincident with the attachment surface with a substantially incompressible particulate filler material selected from the group consisting of a crystalline salt, halite, sodium chloride, boron nitride, a volcanic material, and Pyrofolyte material;

packing the particulate filler material to a predetermined density within the at least one internal cavity and the at least one exterior cavity;

disposing a layer of particulate diamond crystals atop the attachment surface and over the packed particulate filler material in the at least one exterior cavity;

subjecting the holding receptacle, the substrate, the packed particulate filler material and the layer of particulate diamond crystals to an elevated temperature of between about 1450 and 1600° C. and to a high pressure of at least about 50 kilobar while maintaining a presence of the at least one internal cavity and the at least one exterior cavity of the substrate with the packed, particulate filler material for a sufficient time to form a superabrasive table securely bonded to the attachment surface from the layer of particulate diamond crystals;

removing the cutting element from the holding receptacle; and removing the filler material from the at least one internal cavity and the at least one exterior cavity.

* * * * *